US006148809A

United States Patent [19]

Cinquegrani

[11] Patent Number: 6,148,809

[45] Date of Patent: Nov. 21, 2000

[54] OXYGEN SENSOR CONTROLLED CONTINUOUS FLOW FUEL SYSTEM

[76] Inventor: Vincent J. Cinquegrani, 5409 E. Pinchot, Phoenix, Ariz. 85018

[21] Appl. No.: 09/480,241

[22] Filed: Jan. 10, 2000

[51] Int. Cl.[7] ..... F02D 41/14; F02M 69/16

[52] U.S. Cl. ..... 123/683; 123/482; 123/497; 123/681; 123/684

[58] Field of Search ..... 123/482, 497, 123/672, 679, 681, 683, 684, 687

[56] References Cited

U.S. PATENT DOCUMENTS 3,643,635 2/1972 Milam ..... 123/676
3,817,225 6/1974 Priegel ..... 123/482 X
3,926,154 12/1975 Williams ..... 123/689
4,048,964 9/1977 Kissel ..... 123/482
4,426,979 1/1984 Tung ..... 123/438 X

*Primary Examiner*—Tony M. Argenbright
*Attorney, Agent, or Firm*—H. Gordon Shields

[57] ABSTRACT

A continuous flow fuel system includes an oxygen sensor for analyzing the exhaust gases of an engine. The output from the oxygen sensor, representing the oxygen content in the exhaust gases, is transmitted to an electronic control module, which in turn controls the output of a fuel pump. The output of the fuel pump provides fuel to maintain a desired fuel/air ratio. The desired fuel/air ratio may be selected by a user of the engine or it may be predetermined and factory-set.

12 Claims, 1 Drawing Sheet

OXYGEN SENSOR CONTROLLED CONTINUOUS FLOW FUEL SYSTEM

BACKGROUND OF THE INVENTION

1. Field of the Invention

This invention relates to engine fuel systems and, more particularly, to an oxygen sensor which controls a fuel pump for providing fuel for a continuous flow fuel injection system.

2. Description of the Prior Art

Contemporary vehicles with fuel injection systems include an oxygen sensor in the exhaust line. The sensor detects the amount of oxygen in the exhaust gases and controls fuel as required for the required fuel to air ratio. However, when turbo chargers or blowers are added to a stock, naturally aspirated, engine, the stock fuel system usually cannot supply the required additional fuel in many cases. The apparatus of the present invention overcomes this problem by adding additional fuel as required by using an oxygen sensor to control the speed of an electric fuel pump to control the flow of fuel in the continuous flow fuel system. The apparatus of the present invention is a supplement to the stock fuel system of a vehicle, and accordingly the stock fuel system remains in place as designed. The present apparatus may also be used as a stand alone fuel system, if desired.

SUMMARY OF THE INVENTION

The invention described and claimed herein comprises an oxygen sensor controlled continuous flow fuel system which supplements the fuel system on a vehicle engine. The apparatus includes an oxygen sensor which provides an input signal to an electronic control module. Another input to the electronic fuel control module is a fuel mixture selector which is preset or selected by the operator of the vehicle to determine the fuel/air mixture ratio of the fuel system. Other input signals to the electronic control module may be from an engine intake air mass flow sensor, a throttle position sensor, or an intake manifold pressure sensor for providing an input signal to the control module. The output from the electronic control module actuates and controls the speed and fuel flow rate of the fuel pump, which in turn provides fuel from the vehicle's fuel tank to the engine through an additional set of fuel nozzles.

Among the objects of the present invention are the following:

To provide new and useful continuous flow fuel system;

To provide an oxygen sensor controlled continuous flow fuel system;

To provide a new and useful supplemental fuel system for a turbo charged or blown engine;

To provide an oxygen sensor controlled fuel system capable of operating on different types of fuels;

To provide new and useful continuous flow fuel system for supplementing fuel in a turbo charged engine; and To provide new and useful continuous flow fuel system having an input to an electronic control module from an oxygen sensor and from any of selected engine condition sensors.

DESCRIPTION OF THE PREFERRED EMBODIMENT

Figure 1:
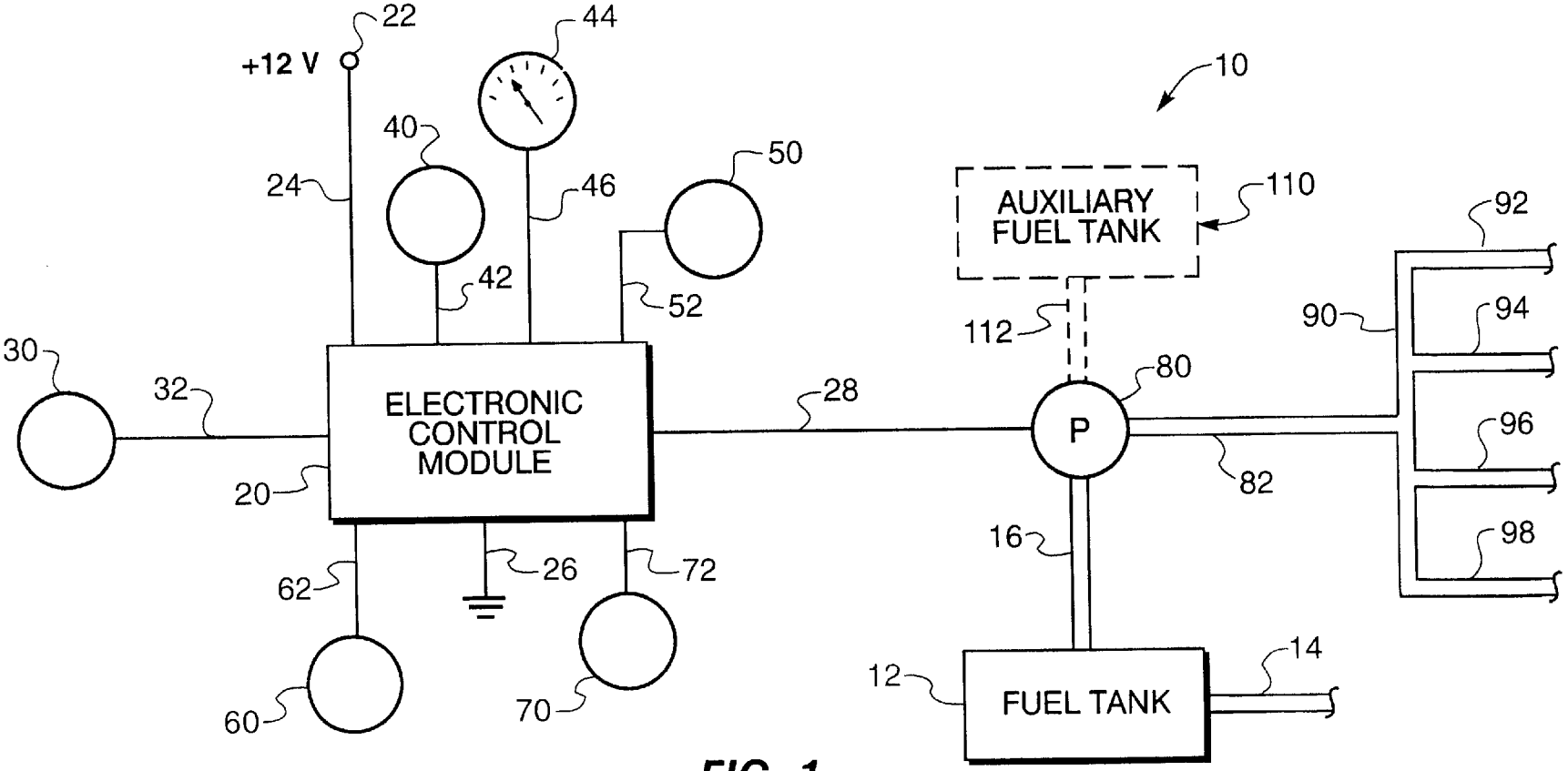
FIG. 1 is a schematic representation of the apparatus of the present invention.

FIG. 1 is a schematic representation of the fuel apparatus 10 of the present invention. The apparatus 10 comprises an oxygen sensor controlled continuous flow system that may work either to augment a stock fuel system in a vehicle or to become a stand alone fuel system in a vehicle. The apparatus 10 is connected to a fuel tank 12 by a conduit 16 by which fuel flows from the vehicle fuel tank 12 to a fuel pump 80, to fuel nozzles (not shown). The fuel system of the present invention may use a separate fuel tank and thus deliver other types of fuel, such as alcohol. This will be discussed below.

A conduit 14 extends from the fuel tank 12 to the stock fuel system (not shown) of the vehicle, if the apparatus 10 is used to supplement or augment the stock fuel system. The stock fuel system includes its own fuel nozzles, etc. (not shown).

The speed controlled continuous flow electric fuel pump 80 is controlled by an electronic control module 20. The electronic control module 20 is connected to the electric fuel pump 80 by a conductor 28.

A twelve volt electric source 22 is schematically illustrated, with a conductor 24 extending from the twelve volt source 22 to the electronic control module 24. A ground conductor 26 is also schematically represented for providing a ground for the electronic control module 20.

It will be understood that some of the other elements in the apparatus also require a twelve volt input and an appropriate ground. However, for convenience and clarity of illustration, only the input and ground for the control module 20 is illustrated.

The electric signal output from the oxygen sensor 30 extends to the electronic control module on a conductor 32. The output of the oxygen sensor 30 is, of course, representative of the oxygen sensed in the exhaust gases from the engine (not shown) in which the present apparatus is installed. The output voltage on conductor 32 varies inversely with the amount of oxygen in the exhaust gases. Thus, the lower the oxygen sensed, the greater the output voltage on conductor 32 to the control module 20. This is well known and understood.

A fuel mixture selector 40 is shown connected to the electronic control module 20 by a conductor 42. A setting for the control mixture selector 40 may be selected by the operator of the vehicle to define the fuel air ratio that the vehicle engine operates at. The oxygen sensor 30 detects the oxygen in the exhaust gases and provides an output representative of the oxygen in the exhaust gases to the electronic control module, which in turn adjusts the speed and thus the fuel flow rate of the fuel pump 80 to provide the desired air/fuel ratio for the engine as defined in terms of the preselected fuel mixture selector 40.

Associated with the fuel/air ratio selector 40 is a fuel/air ratio meter or gauge 44. The meter or gauge 44 is connected to the module 20 by a conductor 46. The meter 44 may, of course, be analog or digital. The meter 44 visually indicates the ratio selected by the selector 40. Thus the operator may visually note the selected ratio. This allows for the precise selection of a fuel/air ratio.

Three other electric signal inputs are illustrated for the electronic control module 20. Those inputs include an engine intake air flow sensor 50 and its conductor 52, a throttle position sensor 60 and its conductor 62, and an intake manifold pressure sensor 70 and its conductor 72. An input from any of the three elements 50, 60, or 70, may be used by the electronic control module 20 to determine when to actuate the apparatus of the present invention. That is, the signal from the air flow sensor is used to determine when to actuate the control module to control the output of the fuel pump 80, or the throttle position sensor signal of the throttle, or the intake manifold pressure sensor signal may be used to determine when to actuate the control module. Regardless of which input is used, the output from the electronic control module 20 on conductor 28 to the fuel pump causes the fuel pump 80 to provide the necessary supplemental fuel through a conduit 82 to deliver a proper quantity of fuel through a separate set of fuel injector nozzles (not shown).

Thus, while there is always a signal output on conductor 36 from the oxygen sensor 30, it is only when a signal is received by the electronic control module 20 from one of the sensors 50, 60, or 70, that the electronic control module by a signal on conductor 28 to the fuel pump 80 will cause a supplemental fuel flow as required to be provided to the engine through a set of nozzles (not shown), separate from the stock fuel nozzles.

From fuel pump 80, a conduit 82 extends to the fuel manifold 90 for the engine through the separate set of fuel nozzles. From the manifold 90, conduits 92, 94, 96, and 98 extend to the fuel nozzles (not shown) of a four cylinder engine for the apparatus 10.

The output of the fuel pump 80 is modulated or controlled by the electronic control module by controlling the voltage on conductor 28 to the fuel pump 80. Thus, the varying voltage on conductor 28 will cause the fuel pump to provide more or less fuel, all in accordance with a predetermined fuel/air ratio from the fuel mixture selector 40 on conductor 42 to the electronic control module 20, and as determined by the oxygen sensor 30.

The apparatus of FIG. 1 can be used as a stand alone fuel system, by the appropriate selection of the signals from the sensors 50, or 60, or 70, or all or some of them, and the oxygen sensor 30, along with the predetermined parameters from the fuel mixture selector 40. The electronic control module 20 then controls the speed of the fuel pump 80 to provide the desired fuel for the predetermined fuel/air ratio for the vehicle engine.

Regardless of whether the apparatus 10 is used to supplement the stock fuel system of a vehicle, or is used in place of the stock fuel system it will be understood that the apparatus provides an oxygen sensor controlled rate of continuous flow of fuel to the fuel nozzles. For a stand alone system, there is one set of nozzles. However, for a supplemental system, the apparatus 10 will have its own set of fuel nozzles, and the stock system will have its own fuel manifold, conduits, and nozzles.

If the apparatus 10 is to be used to provide supplemental fuel of a different type, such as alcohol, then the fuel pump 80 is connected to a supplemental fuel tank 110 shown in dash dot line in FIG. 1. The tank 110 is connected to the pump 80 by a conduit 112, also shown in dash dot line. In such case, the conduit 16 from the stock fuel tank 12 to the pump 80 is eliminated. However, the conduit 82 from the pump 80 to the manifold 90 is still required.

In all other respects, the apparatus 10 operates as discussed above.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A continuous flow fuel system for an engine comprising in combination:

an oxygen sensor for determining the oxygen content in engine exhaust gases and for providing a continuous electric signal output representative of the sensed oxygen content;

a control module for receiving the electric signal output from the oxygen sensor and for providing an output electric signal in response to the received electric signal from the oxygen sensor;

an electric fuel pump connected to the control module for providing a flow of fuel in response to the output electric signal from the control module; and means for selecting a desired fuel/air ratio whereby the control module controls the speed of the fuel pump to continuously provide the fuel required to maintain the desired fuel/air ratio.

2. The apparatus of claim 1 which further includes sensor means connected to the control module for activating the control module to provide an output signal to the fuel pump to control the output of the fuel pump.

3. The apparatus of claim 2 in which the sensor means includes an engine intake air flow sensor.

4. The apparatus of claim 2 in which the sensor means includes a throttle position sensor.

5. The apparatus of claim 2 in which the sensor means includes an intake manifold pressure sensor.

6. The apparatus of claim 1 which further includes a meter for showing the selected fuel/air ratio.

7. A continuous flow fuel system for an engine comprising in combination:

an oxygen sensor for determining the oxygen content in engine exhaust gases and for providing an output representative of the sensed oxygen content;

a fuel/air ratio selector for selecting a desired fuel/air ratio for the engine;

a control module connected to the oxygen sensor and the fuel/air ratio selector for providing an output signal in response to the output from the oxygen sensor and the selected air/fuel ratio; and a fuel pump responsive to the output signal from the control module for providing a continuous flow of fuel to the engine.

8. The apparatus of claim 7 which further includes a meter for displaying the selected fuel/air ratio.

9. The apparatus of claim 8 which further includes sensor means for determining when the control module provides an output signal in response to the output from the oxygen sensor.

10. The apparatus of claim 9 in which the sensor means includes an engine intake air flow sensor.

11. The apparatus of claim 9 in which the sensor means includes a throttle position sensor.

12. The apparatus of claim 9 in which the sensor means includes an intake manifold pressure sensor.

* * * * *